US005738031A

United States Patent [19]

Malina

[11] Patent Number: 5,738,031

[45] Date of Patent: Apr. 14, 1998

[54] HALYARD RETAINER

[76] Inventor: George Malina, 9 City Road, Etobicoke, Ontario, Canada, M8V 2H3

[21] Appl. No.: 697,669

[22] Filed: Aug. 28, 1996

[51] Int. Cl.[6] ..... B63H 9/04

[52] U.S. Cl. ..... 114/102; 114/39.001

[58] Field of Search ..... 114/89, 90, 97, 114/102, 103, 108, 111, 112, 39.1; 116/173, 174

[56] References Cited

U.S. PATENT DOCUMENTS

| | | | |
|---|---|---|---|
| 359,028 | 7/1887 | O'Brien . | |
| 3,418,958 | 12/1968 | Wyatt . | |
| 3,826,223 | 7/1974 | Lingo, Jr. . | |
| 3,918,383 | 11/1975 | Brown . | |
| 3,996,873 | 12/1976 | Weghorn . | |
| 4,157,073 | 6/1979 | Vall . | |
| 4,313,391 | 2/1982 | Hall . | |
| 4,461,230 | 7/1984 | Hartley et al. . | |
| 5,113,776 | 5/1992 | Knecht . | |
| 5,115,754 | 5/1992 | Gray et al. | 114/90 |
| 5,140,921 | 8/1992 | Howlett . | |
| 5,495,818 | 3/1996 | Woodcock | 114/90 |

FOREIGN PATENT DOCUMENTS

| | | | |
|---|---|---|---|
| 443954 | 2/1968 | Germany | 114/90 |

*Primary Examiner*—Ed L. Swinehart
*Attorney, Agent, or Firm*—Paul J. Field

[57] ABSTRACT

The invention provides a halyard retaining device for securing a plurality of halyards to a mast track in a rearward side of an elongate mast, the device comprising: a collar having a plurality of shoulders; a clamp, on the collar, for releasably slidably mounting the collar at any selected position along the mast track; a plurality of arms each having: a base end pivotally mounted to an associated shoulder; and a distal end each having a detent, the arms being independently pivotable to an extended position wherein halyard detents are radially spaced about the mast at a lateral distance therefrom; and a lock, mounted to each of the shoulders and associated arm base ends, for releasably locking each arm in an independently selected extended position relative to the associated shoulder of the collar.

16 Claims, 4 Drawing Sheets

HALYARD RETAINER

BACKGROUND ART

1. Technical Field

The subject invention relates to halyard silencing devices that distances halyards from masts used on sailing vessels, and mast like structures such as flagstaffs having lines extending longitudinally therealong in vertical attitude. Furthermore the subject invention relates to methods which prevent noise and inconvenience generated by halyards and therealong lines when loose and free to collide with vertically oriented masts and mast like structures under the effect of wind and the constant roll of wave action.

2. Description of Related Art

Sailing vessels require masts to support articles typically made of fabric such as a sail. The masts are held in place by wire cables called standing rigging. The ropes or wire cables used to hoist, lower and control sails are called the running rigging (hereinafter referred to as halyards). This includes halyards which raise and lower the sails. While underway, the airstream load in hoisted sails maintain the halyards under constant tension and away from the mast.

When sailing vessels are moored, anchored or docked all halyards are secured under tension by a wide variey of devices like winches, blocks and cleats. No matter how tight the halyards are secured, they eventually slacken, for no adequate force can be exerted by available means to prevent the same from colliding with the mast under windy conditions and the constant roll by wave action. Generally the lines are made of nylon, polyester or polypropylene and all have a tendency to stretch.

Furthermore, the loose halyards constant movement produces wear on lines, spreaders and other fittings on the mast. The noise generated by loose halyards is emitted from masts made from wood, aluminum or carbonfibre. Lately, most masts are made of aluminum, thus all spars ( a collective term for masts, booms and other sail supporting structures ) are hollow. Accordingly the emitted sounds are greately magnified, producing an intolerable noise not only to the crew sleeping or resting on board, but also to the surrounding area. Although several attempts were made to address this issue in the past, there is not a suitable device available on the market today offering a practical solution to this age old problem. To this day sailors still use shock cords to tie up loose halyards to the standing rigging as the only available solution to the problem.

A number of U.S. Patents address the way standing and running rigging, including halyards are mounted and secured on sailing vessels. These patents are: U.S. Pat. Nos. 313,279; 359,028; 378,554; 1,642,716; 2,319,999; 3,173,395; 3,343,514; 3,418,958; 4,230,060; 4,313,391; 4,561,373.

It is important to stress that all these U.S. Patents do not offer any solution regarding halyard noise reduction or elimination. U.S. Pat. Nos. 5,140,921 to Howlett (issued Aug. 13, 1992) and 4,461,230 to Hartley (issued Jul. 24, 1984) disclose means to silence halyards and lines within the mast interior only.

U.S. Pat. No. 4,157,073 to Vall (issued Jun. 5, 1979) addresses methods for silencing halyards by capturing the halyards inside the turns of a plastic helis and simultaneously capturing a shroud. This method is inadequate, for halyards are not detached from mast spreaders at all. Furthermore, due to the flexing shrouds the noise reduction is minimal and only temporary.

U.S. Pat. No. 3,996,873 to Weghorn (issued Dec. 14, 1976) involves a halyard clip mounted on the masts of sailing vessels. The halyard clip is generally an L shaped device attached to the mast for securing the halyard in a fixed position, thereby allowing winches used to raise the sails to be used for other purposes. The subject device was not designed to reduce or eliminate noise generated by loose halyards.

U.S. Pat. No. 3,918,383 to Brown (issued Nov. 11, 1975) is an anti noise device for sailing vessels preventing loose halyards from slaping against the mast. This device is in the shape of a corrugated ring encircling the mast having vertical grooves to accommodate the halyards which are triangular and under tension. The ring is supported on the mast by having inturned ends engaging a track on the mast or by a collar which is buckled onto the mast. This device does not provide a real solution due to the ring application. The small diameter ring would not distance the halyards from the mast enough, whereas the ring having a substantial diameter would make the device flimsy and unstable. The serious weakness of the locking system is quite apparent, for it offers a weak mast grip with no universal application. The storage of the entire device below deck is cumbersome.

U.S. Pat. No. 3,826,223 to Lingo, Jr. (issued Jul. 30, 1974) is halyard clasp for silencing a flagpole halyard in windy conditions which includes a clew that is secured to the flag clasp. The clew encircles the inner halyard run and may be formed integral with the clasp at the point where the halyard is tied off. This system is not suitable for sailing vessels.

Furthermore, tying two halyard runs together at one point, does not stop halyards from colliding with masts on sailing vessels.

U.S. Pat. No. 5,113,776 to Knecht (issued May 19, 1992) discloses a halyard retainer having a 90 degree rotable arm permanently attached to the flagstaff. This device has the operating horizontal position that keeps halyards at a distance from the flagstaff and a vertical storage position which locks the arm along flagstaff. This system is not suitable for sailing vessels, where the halyards extend longitudinally along the mast vertical leading and trailing edge respectively. A serious weakness is apparent due to the fixed mounting system, for the arm is not removable and protrudes even in a locked position, thereby seriously obstructing sail movement during a tacking maneuver. Serious sail damage will occur, if the locking pin is released by accident and the arm drops into the horizontal working position. The halyard retainer application further weakens on sailing vessels where the mast's leading edge is outfitted with the external metal track.

SUMMARY OF THE INVENTION AND ADVANTAGES

Accordingly, besides the objects and advantages of the halyard silencer described in my above patent, several objects and advantages of the invention are:

(a) to provide the user with a halyard silencing device capable of suppressing noise produced by loose halyards colliding with masts on sailing vessels in windy conditions and roll by wave action.

(b) to provide the user with a halyard silencing device capable of suppressing noise which would otherwise be generated by the lines colliding with flagstaffs and vertical mast like structures supporting articles typically made of fabric such as flags.

(c) to provide a method for noise prevention otherwise generated by halyards coming into contact with masts on sailing vessels and flagstaffs and other vertical mast like structures.

(d) to provide a method for mounting the invention upon masts without attaching same to the peripherally engaging halyards.

(e) to provide a universal halyard silencing device that is user friendly, light weight, structurally sound, made from durable material such as plastic, be readily mounted onto masts of different diameters when the sails and the like are lowered and not in use, be readily dismounted from the mast and mast like structures, and be easily stored with collapsed arms below deck.

In achieving the objects of the invention, there results a sailing vessel having a mast, a number of halyards extended longitudinally along the mast to control the positions of sails and the noise eliminating device placed between the mast and halyards to take up the slack when the sails are lowered, thereby preventing the halyards from colliding with the mast, having said halyards peripherally engaging without attaching, thereby facilitating easy mounting and dismounting from the mast.

The noise eliminating device includes:

(a) a collar embracing mast abeam having shoulder bases further supporting pivotably attached plurality of arms, (b) arms extending outwardly in different directions accommodating the peripherally engaged halyards.

(c) joint assemblies comprising a collar base, an arms' base where each have grip locks for securing extended arms in any given position.

(d) a collar crest having rectangular protrusions for locking in the vertical mast groove thereby preventing the device from twisting.

(e) a clamping device pivotably coupled with the collar crest further engaged as a receiving means, mounting the collar onto the mast which provided with a stud glider.

(f) a stud glider placed in the internal vertical mast track facilitates the receiving clamping device pivotably coupled with the collar crest.

(g) resilient dampers anchored in the collar crest providing stability and preventing the device from sliding when mounted on masts of different diameters.

In accordance with aspects of the invention, there are provided methods for:

(a) having the noise eliminating device equipped with a plurality of pivotable arms capable of locking in any given horizontal position.

(b) having the noise eliminating device equipped with an arm's distal end that would simultaneously capture and secure the peripherally engaged halyards at predermine distance from the mast without having the device attached to the halyards.

(c) mounting the noise eliminating device onto the mast by clamping the collar to the stud glider engaged in the internal vertical mast track.

(d) locking the noise eliminating device in the mast's vertical groove thereby preventing the device from twisting.

(e) preventing vibration of the noise eliminating device when mounted onto the mast and exposed to halyard sway due to external forces such as wind and the constant roll of waves.

Other objects, features and methods of the invention as well as its advantages will be readily appreciated as it becomes better understood from the detailed description of some preferred embodiments when considered in connection with the accompanying drawings.

DETAILED DESCRIPTION OF THE PREFERRED EMBODIMENTS

Figure 1:
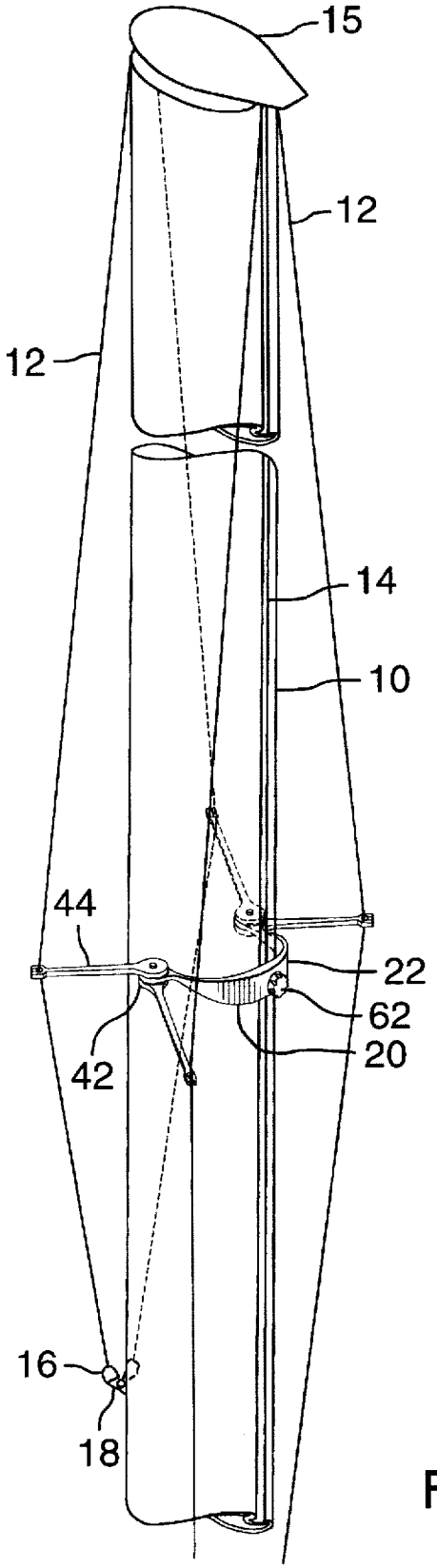
FIG. 1 is a view of the mast's vertical trailing edge on a sailing vessel having halyards extending vertically along the mast with the invention installed on the mast.

In reference to the submitted illustrations, wherein numerals correspond to parts of the invention throughout the several views.

REFERENCE NUMERALS IN DRAWINGS

| | |
|---|---|
| 10 | Mast |
| 12 | Halyards |
| 13 | Vertical mast groove |
| 14 | Internal vertical mast track |
| 15 | Mast head |
| 16 | Halyard shackles |
| 18 | Halyard tender |
| 20 | Halyard silencer |
| 22 | Collar |
| 24 | crest |
| 25 | shoulders |
| 26 | bases |
| 28 | counter bores |
| 30 | central hole |
| 32 | grip locks |
| 34 | disk centre hole |
| 36 | vertical rectangular locking protrusions |
| 38 | vertical rectangular receiving grooves |
| 40 | locking chambres |
| 42 | Joint assemblies |
| 44 | Arms |
| 46 | body |
| 48 | base disk |
| 32 | grip locks |
| 34 | disk centre holes |
| 50 | flat top |
| 52 | distal plate |
| 54 | cavity openning |
| 56 | access passage way |
| 58 | snap in ridge |
| 60 | collared bushing |
| 61 | Mounting device |
| 62 | Clamping device |
| 64 | handle |
| 66 | shaft |
| 68 | shaft groove |
| 70 | receiving hole |
| 72 | Retaining ring |
| 74 | Pivot pin |
| 76 | body |
| 77 | hex head |
| 78 | Quick release wing nut |
| 80 | Compression springs |
| 82 | Stud glider |
| 84 | cylinder/flat bar body |
| 86 | mounting stud |
| 88 | locking pins |
| 90 | foot bar |
| 92 | bar hole |

-continued

| REFERENCE NUMERALS IN DRAWINGS | |
|---|---|
| 94 | Dampers |
| 96 | body |
| 98 | grippers |

In FIG. 1. is illustrated a vertical mast 10 mounted aboard a sailing vessel. Extending longitudinally along the mast are a number of lines called running rigging 12 (hereinafter called halyards). These lines run through a stainless steel sheave box (not shown) incorporated into the mast head 15 located atop the mast 10. Due to the height of the mast, halyards 12 generally under tension, while the vessel is underway, have a tendency to slacken when sails (not shown) are lowered, not in use, and the halyards 12 are under the influence of wind and the constant roll of wave action.

The noise generated by loose halyards 12 colliding with a mast 10 is magnified by hollow spars made from material such as aluminum. The halyards 12 are secured by a wide choice of options. Some are secured on "T" cleats (not shown) located at the foot of the mast 10, whereas others are stowed by halyard shackles 16 at halyard tenders 18 fixedly attached along the vertical leading edge of the mast 10.

Also illustrated in FIG. 1 is the embodiment of the invention 20 when mounted onto the mast 10 having arms 44 extended and placed between the mast 10 and the halyards 12. It is important to emphasize that the invention 20 does not increase tension in the halyards 12. The extended arms 44 capture and push the halyards 12 out and away from the mast 10 in different directions, producing a wider distance between the halyards 12 and the mast 10 and the mast spreaders. The spread is greater than the maximum lateral distance the halyards 12 may sway due to external forces such as wind and the constant roll of wave action.

This illustration includes a collar 22 mounted onto the mast 10 by a clamping device 62. The collar 22 shoulder bases 26 support pivotably attached a number of arms 44 extending outwardly in different directions to secure and distance peripherally engaged halyards 12 without being connected.

In summary, the halyard 12 movement is restricted by means of supports located atop 15 and at the foot of the mast 10 and by the mounted invention 20 having arms between the halyards 12 and the mast 10 that prevent the halyards from colliding with the mast 10 under windy conditions. Accordingly the halyards 12 may swing only in directions parallel to the mast 10 regardless of wind direction, for the wind force cannot blow the halyards 12 out of their positions.

Figure 2:
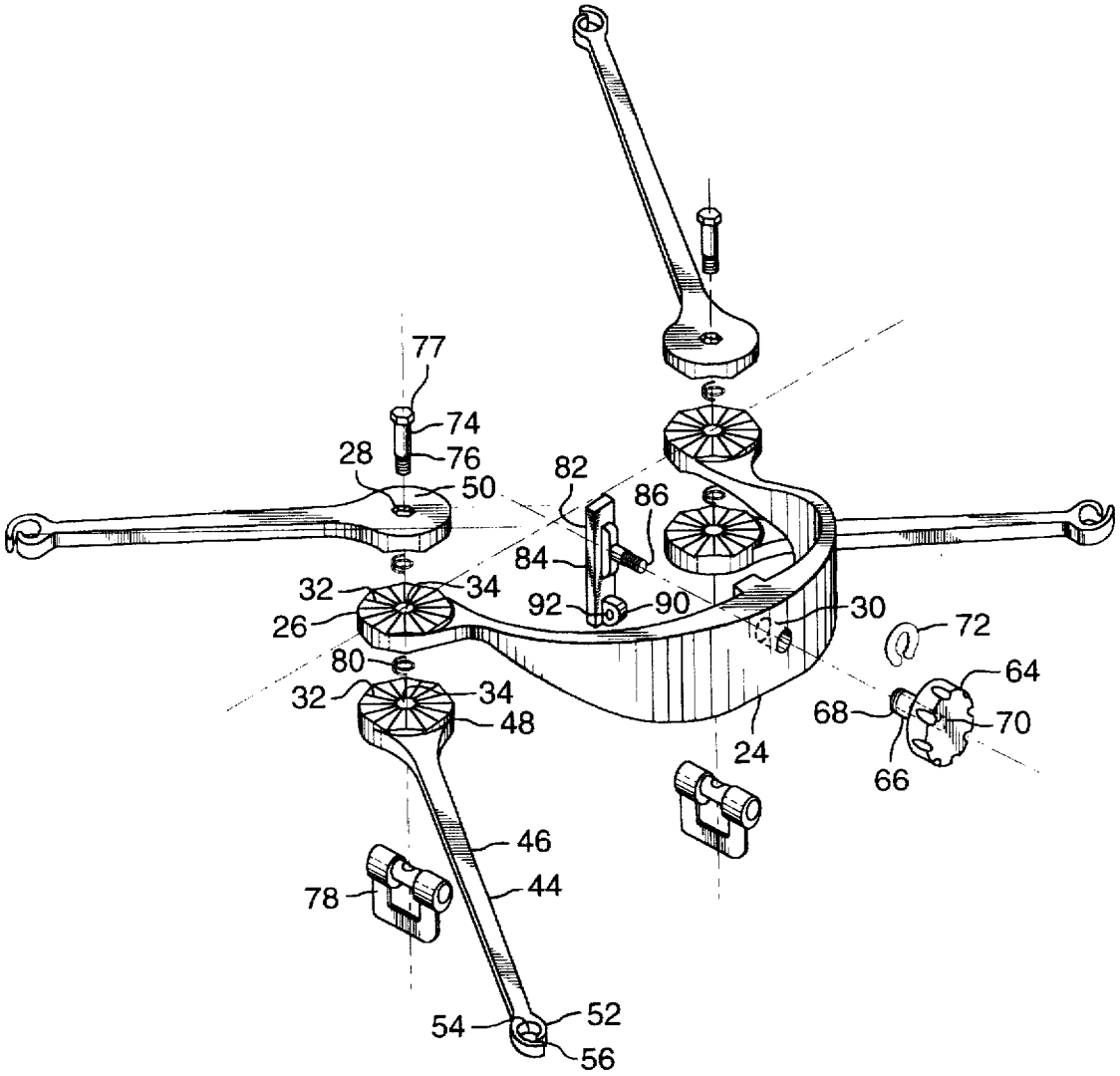
FIG. 2. is an exploded isometric front view of the preferred embodiment of the subject invention.

In the preferred embodiment, as illustrated in FIG. 2 the invention includes the collar 22 comprising a crest 24 having shoulders further characterized by horizontal bases 26 provided with center holes 34 assigned to receive pivot pins 74 securing a number of arms 44 in joint assemblies 42.

Furthermore, the shoulder base 26 surfaces are further characterized by grip locks 32 having teeth arranged in a triangular configuration. The collar 22 includes a hole 30 located at the crest's center accommodating a pivotably coupled clamping device 62 generally employed as a receiving clamp, mounting the collar 20 onto the mast 10.

The illustrations also include a number of arms 44 having a base end disk 48, a distal end plate 52 and body 46 extending therebetween. The base end disks 48 are provided with a receiving center hole 34 whereas the disk surfaces abutting the shoulder bases 26 are equipped with grip locks 32 having teeth arranged in a triangular configuration. The opposite side is plain. The top side of the disks' base 48 center hole is provided with a counter bore 28 accommodating a pivoting pin head 77.

The arms' distal end plate 52 is characterized by a cavity 54 having a semi enclosed-periphery further provided with a narrow passage way 56 coming into contact with or open at the side of the distal end plate allowing the halyards 12 to access the cavity 54 that secures the halyards 12 that may only swing in directions parallel to the mast 10 regardless of wind conditions, for the wind force cannot remove the halyards 12 out of their secured positions.

The collar means 22 shoulder base 26 together with the arms means 44 base end disks 48 form pivotable joint assemblies 42 locking the arms 44 in designated positions. The ease of arm rotation is facilitated by compression springs 80 sandwiched between assembly disks 26 and 48. The joint assemblies 42 in the illustrated embodiment are secured by a pivotable pin 74 having fastening means 76 and clamping means such as a quick release wing nut 78.

In the FIG. 2 is illustrated the preferred embodiment of the clamping device 62 comprising a handle 64 having a fixedly inserted cylinder shaft 66 provided at the distal end with a groove 68 and a receiving hole 70 extended the full length of the shaft equipped with the clamp. The retaining ring 72 inserted in the shaft groove 68 allows the clamping device 62 to swivel when coupled with the collar means 22. Furthermore, the clamping device 62 mounts the collar means 22 onto the mast 10 by clamping to the stud glider 82 engaged in the internal vertical mast track 14.

The illustration also includes a stud glider 82 which is an integral member of the mounting means incorporated into the invention 20. The hoisting of sails pushes the glider means 82 up the internal vertical mast track 14 ahead of a series of sail sliders (not shown) where the glider means 82 remains for the duration of sailing activity. As the sails are lowered, so are the said glider means 82 that are tied up with the first sail slider by an adjustable chain link. The released glider means 82 mount the said subject invention 20 onto the mast 10. The stud glider 82 is comprised of a cylinder or flat bar body 84, a centrally located mounting stud 86 outfitted with clamping means and a foot bar 90 characterized by a receiving hole 92 accommodating the adjustable chain link (not shown).

Figure 3:
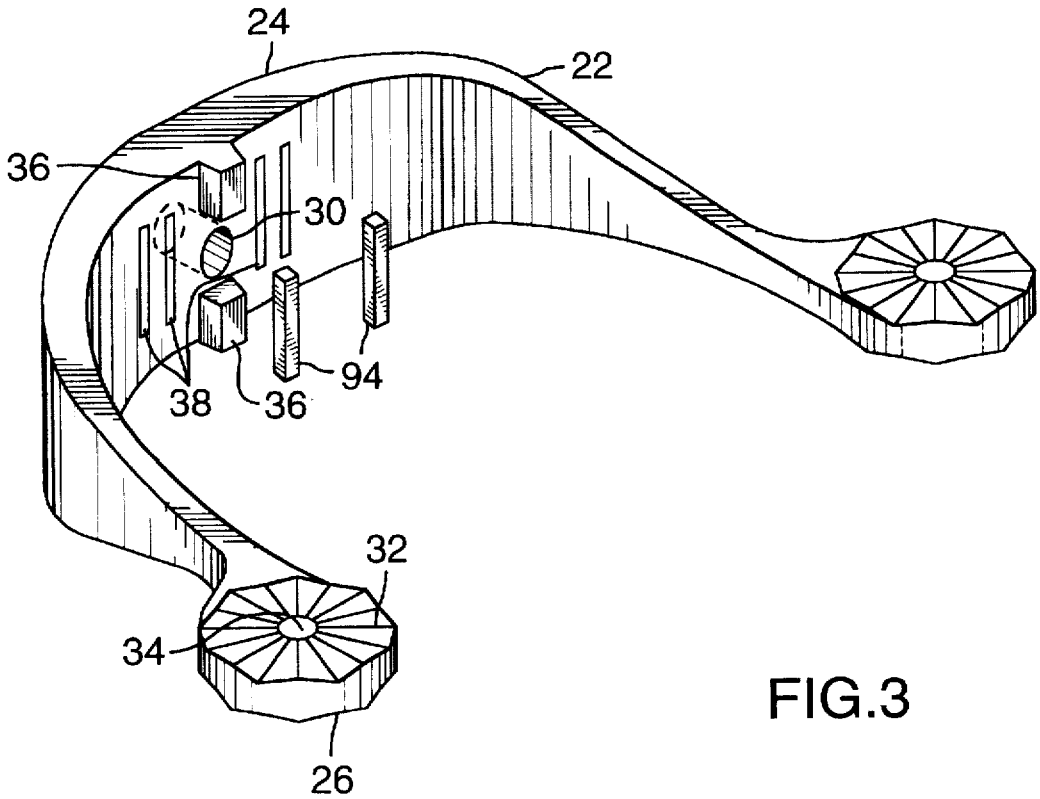
FIG. 3. is an exploded isometric rear view of the preferred embodiment of the subject invention.

In FIG. 3 is illustrated the preferred embodiment of the collar means 22 having the crest 24 further characterized by centrally located vertical rectangular protrusions 36, a number of receiving vertical rectangular grooves 38 located off center and parallel to the rectangular protrusions 36 accomodating dampers 94. During the mounting process the rectangular protrusions 36 lock in the vertical mast track 14, whereby the invention 20 is being simultaneously mounted and locked onto the mast 10. The locked rectangular protrusions 38 safeguard the collar means 22 from twisting.

The dampers 94 in the illustrated preferred embodiment include elongated cylindrical body 96 having grippers 98 that anchor in the crest 24 wall rectangular vertical grooves 38. This strategic placement provides the collar means 22 with stability when mounted onto masts of differring diameters, for the dampers 94 absorb shocks generated by the halyards 12 during stormy weather conditions. Furthermore, the dampers 94 stop the collar 22 from sliding.

While the above submitted description contains many specifications, these should not be construed as limitations on the scope of the invention, but rather as an example of one preferred embodiment. Many other variations are possible.

Figure 4:
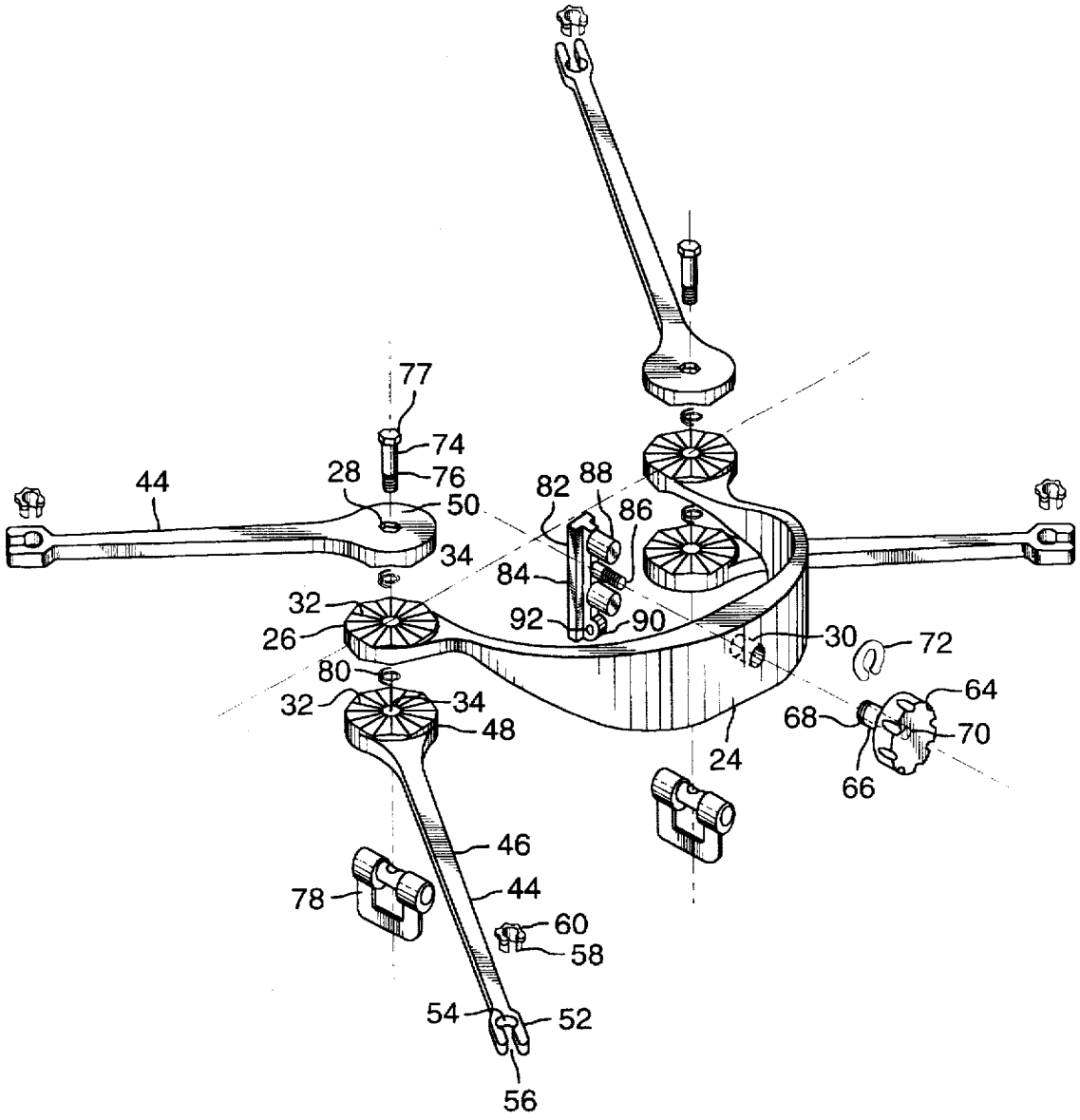
FIG. 4. is an exploded isometric front view of an alternative embodiment of the subject invention.
Figure 5:
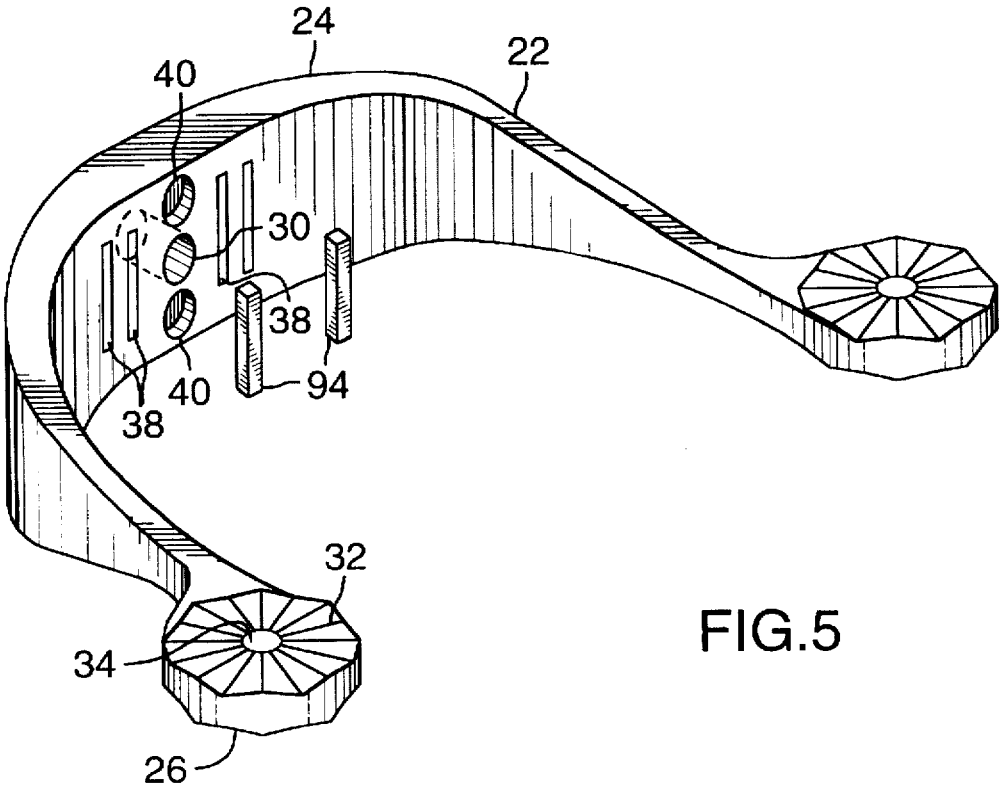
FIG. 5. is an exploded isometric rear view of an alternative embodiment of the subject invention.

For example, alternative embodiments are illustrated in FIGS. 4 and 5.

In the alternative embodiment illustrated in FIG. 4 the invention 20 includes the arms means 44 having the distal end plates 52 characterized by a cavity 54 having the halyards 12 access passage way 56 come into contact with or open at the end of the distal end plate 52. Furthermore, the cavity 54 is equipped with a rotating semi-enclosed collared bushing 60 secured by a snap in ridge 58. The rotated bushing 60 secures engaged halyards 12 in the cavity 54.

In the alternative embodiment illustrated in FIG. 4 the invention 20 also includes the stud glider 82 comprising the body 84 having the centrally located mounting stud 86, two shorter locking pins 88 located above and below the mounting stud 86 and the foot bar 90 having the receiving hole 92.

Furthermore, in FIG. 5 is illustrated an alternative embodiment of the invention 20 comprising of the collared 22 having the crest 24 inner wall characterized by two locking chambers 40. During the mounting process the locking pins 88 anchor in the crest 24 wall locking chambers 40 thereby simultaneously locking and mounting the invention 20 onto the mast 10.

The invention has been described in an illustrative manner, and it is to be understood that the terminology which has been used is intended to be in the nature of words of description rather than limitation.

Obviously, many modifications and variations of the present invention are possible in light of the above descriptions. It is, therefore, to be understood that within the scope of the appended claims, submitted reference numerals are merely for convenience and not to be in any way limiting, the invention may be designed otherwise than as specifically described.

The embodiments of the invention in which an exclusive property or privilege is claimed are defined as follows:

1. A halyard retaining device for securing a plurality of halyards to a mast track in a rearward side of an elongate mast, the device comprising:

a collar having a plurality of shoulders;

clamping means, on the collar, for releasably slidably mounting the collar at any selected position along the mast track;

a plurality of arms each having: a base end pivotally mounted to an associated shoulder; and a distal end each having halyard detent means, the arms being independently pivotable to an extended position wherein a plurality of said halyard detent means are radially spaced about the mast at a lateral distance therefrom; and locking means, mounted to each of the shoulders and associated arm base ends, for releasably locking each arm in an independently selected extended position relative to the associated shoulder of the collar.

2. A halyard retaining device according to claim 1 wherein at least one halyard detent means in said extended position is adapted to be disposed a lateral distance from a forward side of the mast.

3. A halyard retaining device according to claim 2 wherein at least one halyard detent means in said extended position is adapted to be disposed a lateral distance from a rearward side of the mast.

4. A halyard retaining device according to claim 1 wherein said locking means comprise compression spring means for disengaging the shoulders and arm base ends.

5. A halyard retaining device according to claim 4 wherein the arm base ends are mounted to the shoulders with bolts and the locking means further comprise quick release nuts coacting with said bolts.

6. A halyard retaining device according to claim 1 wherein the shoulders and base ends include interlocking teeth.

7. A halyard retaining device according to claim 6 wherein the teeth are of triangular configuration extending radially outwardly from a clamping bolt.

8. A halyard retaining device according to claim 1 wherein the halyard detent means comprise a cavity having a semi-enclosed periphery.

9. A halyard retaining device according to claim 1 wherein the halyard detent means comprise a cavity of circular profile with an open mouth subtending an acute angle of the profile, a bushing mounted for rotation in said cavity, the bushing having an open mouth adapted to be aligned with said open mouth of said cavity.

10. A halyard retaining device according to claim 1 wherein the clamping means comprise stud glider means for sliding in the track and frictionally engaging an interior surface of the track.

11. A halyard retaining device according to claim 10 wherein the clamping means further comprise a mounting stud extending from the stud glider and handle means engaging the mounting stud for laterally moving the stud glider relative to the collar.

12. A halyard retaining device according to claim 1 wherein the collar includes protrusion means on an interior surface thereof for engaging an interior side edge of the track and for preventing twisting of the collar relative to the mast.

13. A halyard retaining device according to claim 12 wherein the protrusion means comprise rectangular protrusions adjacent an upper and a lower crest edge of the collar.

14. A halyard retaining device according to claim 1 wherein the collar includes resilient dampers on an interior surface thereof.

15. A halyard retaining device according to claim 1 including four arms.

16. A halyard retaining device according to claim 10 wherein the stud glider includes a foot bar and bar hole.

* * * * *